US005513802A

United States Patent [19]

Ueki

[11] Patent Number: 5,513,802

[45] Date of Patent: May 7, 1996

[54] REVOLVING NOZZLE WITH FLUID LEAKAGE PREVENTION DEVICE

[75] Inventor: Hiroshi Ueki, Kanagawa, Japan

[73] Assignee: Nippon Thompson Co., Ltd., Tokyo, Japan

[21] Appl. No.: 299,660

[22] Filed: Sep. 2, 1994

Related U.S. Application Data

[63] Continuation of Ser. No. 32,243, Mar. 17, 1993, abandoned.

[30] Foreign Application Priority Data

Mar. 27, 1992 [JP] Japan ..... 4-100330

[51] Int. Cl.[6] ..... B05B 1/30

[52] U.S. Cl. ..... 239/571; 239/587.5

[58] Field of Search ..... 239/587.5, 570, 239/571, 533.15; 137/511; 267/166.1

[56] References Cited

U.S. PATENT DOCUMENTS

| | | | |
|---|---|---|---|
| 2,254,123 | 8/1941 | Soaper | 239/571 X |
| 2,990,980 | 7/1961 | Gronemeyer | 239/587.5 X |
| 3,033,467 | 5/1962 | Hofer | 239/571 X |
| 3,053,459 | 9/1962 | Corsette | 239/571 X |
| 3,098,610 | 7/1963 | Stram | 239/571 X |
| 3,147,924 | 9/1964 | Schulze | 239/533.15 X |
| 4,111,407 | 9/1978 | Stager | 267/166.1 |
| 4,765,365 | 8/1988 | Roland | 267/166.1 X |
| 4,995,346 | 2/1991 | Hudson, Jr. | 239/570 X |
| 5,002,230 | 3/1991 | Norskov et al. | 239/570 X |
| 5,119,989 | 6/1992 | Kamis | 239/571 X |

FOREIGN PATENT DOCUMENTS

| | | | |
|---|---|---|---|
| 2-553 | 1/1990 | Japan . | |
| 1155285 | 6/1969 | United Kingdom | 239/570 |

*Primary Examiner*—Andres Kashnikow
*Assistant Examiner*—Lesley D. Morris
*Attorney, Agent, or Firm*—Sughrue, Mion, Zinn, Macpeak & Seas; Richard C. Turner; Joseph J. Buczynski

[57] ABSTRACT

The supply of fluid to a nozzle is interrupted by stopping the supply of fluid by providing a fluid leakage prevention device, that is opened by fluid supply pressure, inside a fluid feed hole possessed by a housing that holds a sphere integrated into a single unit with a tube member (nozzle) while allowing said sphere to rotate.

7 Claims, 3 Drawing Sheets

REVOLVING NOZZLE WITH FLUID LEAKAGE PREVENTION DEVICE

This is a Continuation of application Ser. No. 08/032,243 filed Mar. 17, 1993 now abandoned.

BACKGROUND OF THE INVENTION

1. Field of the Invention

The present invention relates to a revolving nozzle for spraying a fluid, such as cutting oil, on the processed portion and so forth of a workpiece in order to improve cooling efficiency and cutting efficiency, by reducing the friction of that processed portion, in the case of machining by a machine tool, such as in the case of cutting a workpiece by a tool such as a lathe cutting tool or drill.

2. Description of the Prior Art

FIG. 1 is a schematic drawing of a boring machine equipped with a revolving nozzle of this type. Drill 2 is mounted in the center of spindle end 1, and drilling is performed on workpiece 3. A plurality of revolving nozzles 4 are mounted at equal intervals around the center of drill 2 on spindle end 1. Each of said revolving nozzles 4 is directed towards the portion where drill 2 and workpiece 3 make contact to improve cooling efficiency and cutting efficiency.

A known example of the specific constitution of the above-mentioned revolving nozzle is indicated in Examined Japanese Utility Model Publication No. 2-553 (Utility Model Application No. 57-19580).

As indicated in FIGS. 2 and 3, this revolving nozzle is equipped with sphere 12 containing fluid circulation hole 11, tube member 13 mounted on one end of said fluid circulation hole 11, and housing 15 provided with fluid feed hole 14 that fits together with and holds sphere 12, and connects with the above-mentioned fluid circulation hole 11. The above-mentioned sphere 12 is held within housing 15 while being allowed to rotate by locking member 16 provided on the open end of housing 15. Thus, if housing 15 is attached to a fluid supply apparatus (such as a machine tool) by locking portion 17 formed around the periphery of housing 15, the supplied fluid is sprayed from tube member 13 after passing through fluid circulation hole 11. The direction of spraying can be adjusted as desired by turning sphere 12. Packing 18 provided in housing 15 prevents the leakage of fluid outside the circulation path even during turning of sphere 12.

In the above-mentioned revolving nozzle of the prior art, fluid accumulated in the tube that connects the revolving nozzle with the fluid storage tank ends up dripping from the end of tube member 13 (nozzle) even after the fluid supply source, such as that at the machine tool side, is stopped. As a result, said revolving nozzle of the prior art has the shortcoming of, for example, dripping fluid on a worker during replacement of a workpiece, or indiscriminately soiling the work table.

SUMMARY OF THE INVENTION

In consideration of the above-mentioned shortcomings of the prior art, the object of the present invention is to provide a revolving nozzle wherein fluid accumulated partway in a tube does not leak from the end of the nozzle when fluid supply is stopped.

The revolving nozzle pertaining to the present invention comprises a revolving nozzle equipped with: a sphere containing a fluid circulation hole; a tube member mounted on one end of said fluid circulation hole; and, a housing provided with a fluid feed hole that fits together with and holds said sphere while allowing the sphere to rotate, and that is connected with said fluid circulation hole; wherein, a fluid leakage prevention device that is opened by fluid supply pressure is provided within the above-mentioned fluid feed hole.

DESCRIPTION OF THE PREFERRED EMBODIMENTS

The following provides a detailed explanation of an embodiment of the present invention with reference to the drawings.

Figure 1:
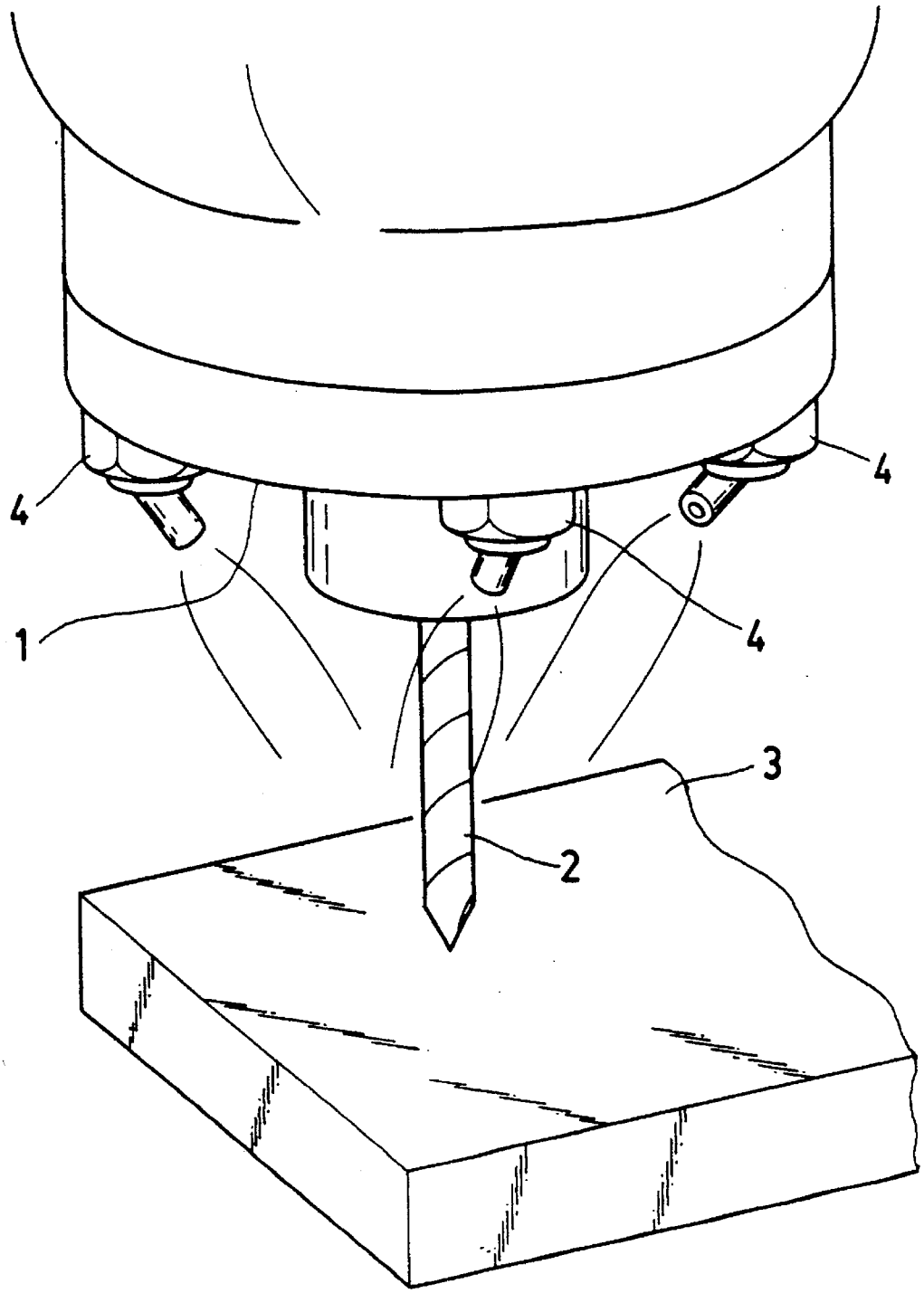
Fig.1 PRIOR ART
FIG. 1 is a schematic drawing of a boring machine using a revolving nozzle.
Figure 2:
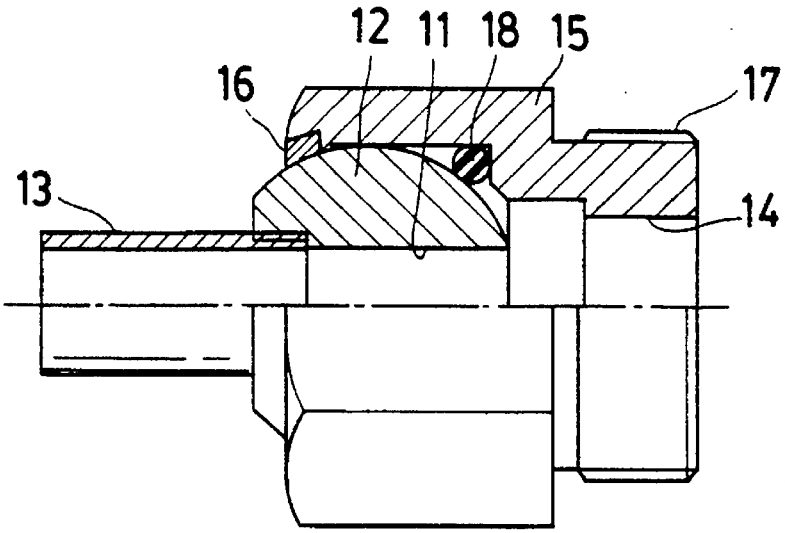
Fig.2 PRIOR ART
FIG. 2 is frontal cross-sectional view of a revolving nozzle of the prior art.
Figure 3:
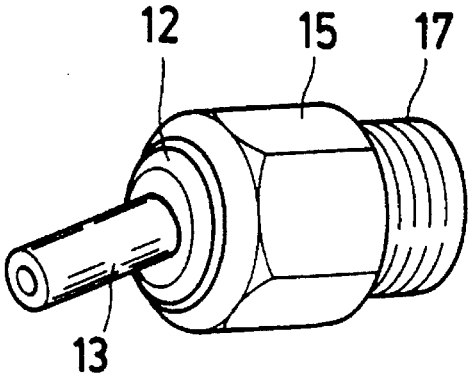
Fig.3 PRIOR ART
FIG. 3 is a perspective view of a revolving nozzle of the prior art.
Figure 4:
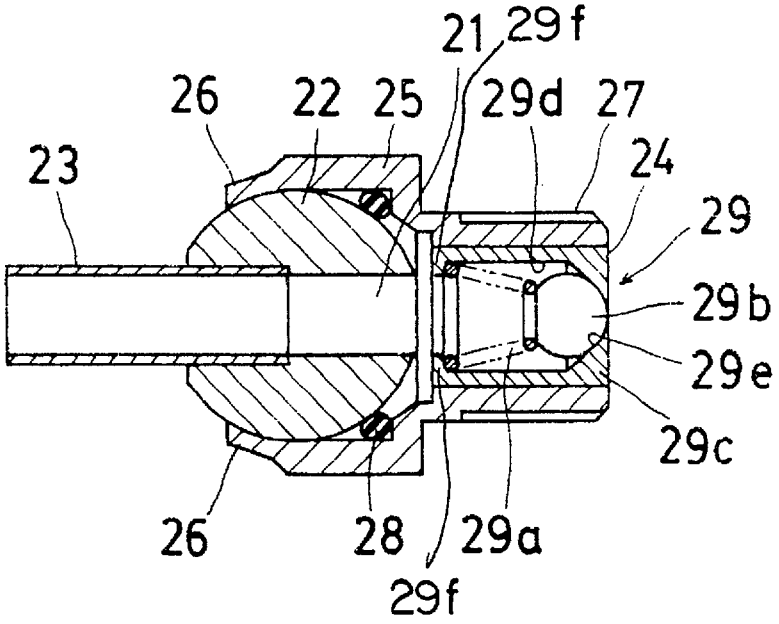
FIG. 4 is a frontal cross-sectional view of the revolving nozzle pertaining to the present invention.
Figure 5:
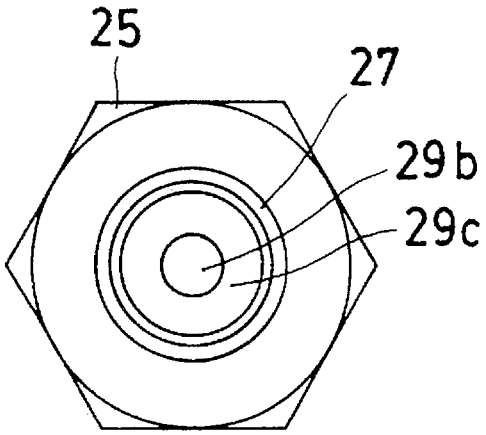
FIG. 5 is a right side view of the revolving nozzle indicated in FIG. 4.

FIG. 4 is a frontal cross-sectional view of the revolving nozzle pertaining to the present invention, while FIG. 5 is a right side view of said revolving nozzle.

In the drawings, said revolving nozzle is equipped with sphere 22 containing fluid circulation hole 21, tube member 23 mounted on one end of fluid circulation hole 21 of sphere 22, and housing 25 provided with fluid feed hole 24 fit together with the holding sphere 22, and connected with the above-mentioned fluid circulation hole 21. Sphere 22 is held within housing 25 so as to be able to rotate as a result of the diameter of open end 26 of housing 25 being narrowed. The tube member 23 is freely tiltable to effect rotation of the sphere 22. 27 is a locking portion for attaching the revolving nozzle to a fluid supply apparatus, while 28 is a packing for preventing the leakage of the fluid inside housing 25.

As indicated in FIGS. 4 and 5, the outside diameter of the portion of the above-mentioned housing 25 that holds sphere 22 is relatively large and in the shape of a hexagon nut, while the portion having fluid feed hole 24 on the inside and locking portion 27 around the outside has a smaller diameter. Fluid leakage prevention unit 29, comprised of coil spring **29*a*, ball 29*b* and casing 29*c*, is provided within fluid feed hole 24**.

As described above, fluid leakage prevention device 29 is integrated into a unit by a casing **29*c*, the outer diameter of which is roughly equal to the inner diameter of fluid feed hole 24 of housing 25. This casing 29*c* is mounted inside fluid feed hole 24** by either screwing or press fitting.

Casing **29*c* has circulation path 29*d* in its axial direction, and the above-mentioned ball 29*b* and coil spring 29*a* are housed within circulation path 29*d*. Ball 29*b* is flexibly provided between valve seat portion 29*e*, having a tapered cross-section, formed on one end of circulation path 29*d* against wall 29*f* of casing 29*c*, and the other end of coil spring 29*a*, of which one end is locked to the other end of circulation path 29*d*. The spring 29*a* in the preferred embodiment illustrated in FIG. 4 is conical-shaped. The narrow conical end of the spring 29*a* presses against the ball 29*b*, and the broad conical end of the spring 29*a* presses against the left side of the fluid leakage prevention device 29. Said ball 29b is continuously pressed against valve seat portion 29e by coil spring 29a. Thus, circulation path 29d is normally closed as a result of ball 29b being pressed against valve seat portion 29e**.

When cutting oil or the like is supplied at a prescribed pressure from a storage tank to the revolving nozzle having the constitution described above, ball 29b moves to the left in FIG. 4 in opposition to the exerted force of coil spring 29a due to this supply pressure, thus resulting in said ball 29b moving away from valve seat portion 29e. Thus, the valve comprised of ball 29b and valve seat portion 29e is opened, and fluid is sprayed from tube member 23 after flowing within circulation path 29d and passing through fluid circulation hole 21 of sphere 22. The direction of spraying is adjusted as desired by turning sphere 22 within housing 25.

When the supply of fluid is stopped, since the fluid pressure drops to that roughly equal to atmospheric pressure, ball 29b is again pressed against valve seat portion 29e by the exerted force of coil spring 29a, the valve is closed, and circulation path 29d is interrupted at that point. At this time, the residual fluid that can be supplied to tube member 23 is only that remaining in tube member 23, sphere 22 and casing 29c. The amount of that fluid is extremely low, and there is no other leakage of fluid accumulated in the tubing.

Furthermore, in the case of supplying cutting oil while mounting said revolving nozzle on the end of a spindle of a boring machine and so on, the spring pressure of coil spring 29a in the above-mentioned embodiment is preferably 2 $kgf/cm^2$ or less. However, this spring pressure should be suitably set according to the type of fluid and the amount of pressure applied to the fluid.

In addition, in the above-mentioned embodiment, since the fluid leakage prevention device is formed into a unit by casing 29c, and this cylindrical unit need only be attached by simply screwing or press fitting into the fluid feed hole of the revolving nozzle of the prior art, installation work is simple and assembly of the entire revolving nozzle is easy.

Furthermore, although the combination of a ball and coil spring was used for the fluid leakage prevention device in the above-mentioned embodiment, various modifications can be made in order to carry out the present invention as long as said device is opened by fluid pressure.

According to the present invention as explained above, fluid is sprayed from a nozzle by fluid pressure, and the further supply of fluid within a revolving nozzle is interrupted by stopping the supply of fluid. Thus, there is no leakage of fluid accumulated within the tube from the fluid storage tank to the revolving nozzle, from the revolving nozzle. Consequently, there is no dripping of fluid workers during performance of machining work or soiling of the workshop.

In addition, the unnecessary use of fluid can also be prevented.

Moreover, since the locking portion that locks the sphere is integrated into a single unit with the opening of a housing, a special-purpose locking member for performing that locking is not required, thus resulting in reduced costs.

What is claimed is:

1. A revolving nozzle, comprising:

a sphere containing a fluid circulation hole;

a tube member mounted on one end of said fluid circulation hole;

a housing provided with a fluid feed hole that fits together with and holds said sphere while allowing said sphere to rotate, and that is connected with said fluid circulation hole, said tube member being freely tiltable to effect rotation of said sphere;

a packing member bearing against said housing and said sphere; and a fluid leakage prevention device, openable by fluid supply pressure, provided within said fluid feed hole, said fluid leakage prevention device comprising an inner wall having a side closest to said sphere, a valve seat portion provided within a portion of said housing serving as a locking element, a ball performing liquid sealing action by making contact with said valve seat portion, and a conical spring member that presses said ball against said valve seat portion, the conical spring member having a first end directly contacting the ball and a second end directly contacting the side.

2. A revolving nozzle, comprising:

a sphere containing a fluid circulation hole;

a tube member mounted on one end of said fluid circulation hole;

a housing provided with a fluid feed aperture that fits together with and holds said sphere while allowing said sphere to rotate, and that is connected with said fluid circulation hole, said tube member being freely tiltable to effect rotation of said sphere;

a packing member bearing against said housing and said sphere; and a fluid leakage prevention device, openable by fluid supply pressure, provided within said fluid feed aperture, said fluid leakage prevention device comprising an inner wall having a side closest to said sphere, a valve seat portion provided within a portion of said housing serving as a locking element, closure means performing liquid sealing action by making contact with said valve seat portion, and a conical spring member that presses said closure means against said valve seat portion, the conical spring member having a first end directly contacting the closure means and a second end directly contacting the side.

3. A revolving nozzle, comprising:

a sphere containing a fluid circulation hole;

a tube member mounted on one end of said fluid circulation hole;

a housing provided with a fluid feed aperture that fits together with and holds said sphere while allowing said sphere to rotate, and that is connected with said fluid circulation hole, said tube member being freely tiltable to effect rotation of said sphere;

a packing member bearing against said housing and said sphere; and a fluid leakage prevention device, openable by fluid supply pressure, provided within said fluid feed aperture, said fluid leakage prevention device comprising an inner wall having a side closest to said sphere, a valve casing fitted into said fluid feed aperture, at a location where said housing surrounding said fluid feed aperture forms a locking element, by one of press fitting or threaded engagement, a valve seat portion provided within said casing, closure means performing liquid sealing action by making contact with said valve seat portion, and a spring member that presses said closure means against said valve seat portion, the spring member being conical and having a first end directly contacting the closure means and a second end directly contacting the side.

4. A revolving nozzle, comprising, a sphere containing a fluid circulation hole;

a housing provided with a fluid feed aperture that fits together with and holds said sphere while allowing said sphere to rotate, and that is connected with said fluid circulation hole, said tube member being freely tiltable to effect rotation of said sphere;

a packing member bearing against said housing and said sphere; and a fluid leakage prevention device, openable by fluid supply pressure, provided within said fluid feed aperture, said fluid leakage prevention device comprising an inner wall having a side closest to said sphere, a valve seat portion provided within a portion of said housing serving as a locking element, a ball performing liquid sealing action by making contact with said valve seat portion, and a conical spring member that presses said ball against said valve seat portion, the conical spring member having a first end directly contacting the ball and a second end directly contacting the side.

5. A revolving nozzle, comprising:

an at least partially spherical member containing a fluid circulation hole;

a housing provided with a fluid feed aperture that fits together with and holds said member while allowing said member to pivot, and that is connected with said fluid circulation hole, said tube member being freely tiltable to effect pivoting of said sphere;

a packing member bearing against said housing and said sphere; and a fluid leakage prevention device, openable by fluid supply pressure, provided within said fluid feed aperture; said fluid leakage prevention device comprising an inner wall having a side closest to said at least partially spherical member, a valve seat portion provided within a portion of said housing serving as a locking element, an element performing liquid sealing action by making contact with said valve seat portion, and a conical spring member that presses said element against said valve seat portion, the conical spring member having a first end directly contacting the liquid sealing action element and a second end directly contacting the side.

6. A revolving nozzle, comprising:

a sphere containing a fluid circulation hole;

a tube member mounted on one end of said fluid circulation hole;

a hexagonal-shaped housing comprising a sphere holding portion having an opening therein for holding said sphere while allowing said sphere to rotate, and a fluid feed hole portion provided with a fluid feed hole that communicates with said opening in said sphere holding portion and is connected with said fluid circulation hole, said tube member being freely tiltable to effect rotation of said sphere, said fluid feed hole having a smaller diameter than a diameter of said opening in said sphere holding portion and said fluid feed hole portion having a smaller cross sectional area than a cross sectional area of said sphere holding portion, said sphere holding portion and said fluid feed hole portion cooperating to form a step, said fluid feed holding portion further having a locking portion for connecting to a fluid supply apparatus;

a packing member against said sphere and an inner wall of said sphere holding portion; and a fluid leakage prevention device, openable by fluid supply pressure, provided within said fluid feed hole, said fluid leakage prevention device comprising an inner wall, a conical-shaped valve seat portion which is proximate to a portion of said fluid feed hole portion furthest away from said sphere holding portion and serves as a locking element, a ball performing liquid sealing action by making contact with said valve seat portion when said fluid supply pressure is below a predetermined value, and a conical spring member that urges said ball toward said valve seat portion to thereby cause said ball to contact said valve seat portion when said fluid supply pressure is below said predetermined amount, said conical spring member having a first end directly contacting the ball and a second end directly contacting the portion of the inner wall closest to the sphere holding portion, and a predetermined coefficient of elasticity to allow fluid flowing from said fluid supply apparatus to push said ball away from said valve seat portion in a direction toward said sphere holding portion when said fluid supply pressure is at least equal to said predetermined value to allow said fluid to flow through said fluid feed hole, said fluid circulation hole, and said tube member.

7. A revolving nozzle, comprising:

a sphere containing a fluid circulation hole;

a tube member mounted on one end of said fluid circulation hole;

a housing, provided with a fluid feed hole that holds said sphere while allowing said sphere to rotate, said fluid feed hole communicating with said fluid circulation hole; and a fluid leakage prevention device, openable by fluid supply pressure, provided within said fluid feed hole, said fluid leakage prevention device comprising, in the form of a unit:

a casing, the outer diameter of which is approximately equal to the inner diameter of said liquid feed hole of said housing, said casing including a valve seat portion, having a tapered cross-section, formed at one end of a circulation path;

a ball performing liquid sealing action by contacting with said valve seat portion; and a conical spring member, one end of which being locked to the other end of said circulation path, and the other end of which pressing said ball against said valve seat portion;

said unit being screwed or press fit into said fluid feed hole.

* * * * *